US005668435A

United States Patent [19]

Uchida et al.

[11] Patent Number: 5,668,435

[45] Date of Patent: Sep. 16, 1997

[54] COLOR DISPLAY SYSTEM WITH COLOR CATHODE RAY TUBE HAVING A HIGH BREAKDOWN VOLTAGE

[75] Inventors: Go Uchida; Shoji Shirai; Takashi Kinami, all of Mobara; Noboru Mizukami, Isumi-gun, all of Japan

[73] Assignees: Hitachi, Ltd., Tokyo; Hitachi Electronics Devices Co., Ltd., Mobara, both of Japan

[21] Appl. No.: 507,991

[22] Filed: Jul. 27, 1995

[30] Foreign Application Priority Data

Aug. 1, 1994 [JP] Japan ..... 6-180237

[51] Int. Cl.[6] ..... H01J 29/50; H01J 29/46; H01J 31/00; G09G 1/04

[52] U.S. Cl. ..... 313/414; 313/441; 313/477 HC; 315/382

[58] Field of Search ..... 313/412, 414, 313/477 HC, 421, 441, 624, 625, 283–84, 285–86, 290, 337; 315/3, 14–15, 382, 382.1

[56] References Cited

FOREIGN PATENT DOCUMENTS

| | | |
|---|---|---|
| 60-10549 | 1/1985 | Japan . |
| 308850 | 12/1988 | Japan . |
| 63-308850 | 12/1988 | Japan . |
| 1-32036 | 5/1989 | Japan . |
| 1-109164 | 7/1989 | Japan . |
| 3-26955 | 3/1991 | Japan . |

*Primary Examiner*—Sandra L. O'Shea
*Assistant Examiner*—Mack Haynes
*Attorney, Agent, or Firm*—Antonelli, Terry, Stout & Kraus, LLP

[57] ABSTRACT

A color display system including color cathode ray tube has an evacuated envelope including a panel which carries a phosphor screen, a glass neck which houses an electron gun mount assembly, a funnel connecting the faceplate panel and the glass neck, and a stem having a plurality of leads therethrough sealed to and closing the neck at an end thereof; and an electron gun mount assembly. The electron gun mount assembly is supported on the stem via the plurality of leads and has a cathode for generating an electron beam and directing it toward the phosphor screen, a beam control grid electrode, an accelerating electrode, a plurality of focusing electrodes, one of which focusing electrodes is adapted to be supplied with a voltage varying in accordance with an amount of deflection of the electron beam, an anode electrode, and a heater for heating the cathode. One of two terminals of the heater and the beam control grid electrode is connected to a common one of the plurality of leads for being supplied with a variable voltage for beam control. The other one of the two terminals of the heater is adapted to be supplied with a sum of the variable voltage for beam control and a voltage for heating the cathode.

4 Claims, 6 Drawing Sheets

COLOR DISPLAY SYSTEM WITH COLOR CATHODE RAY TUBE HAVING A HIGH BREAKDOWN VOLTAGE

BACKGROUND OF THE INVENTION

The present invention relates to a color display system including a color cathode ray tube and more particularly to a color cathode ray tube having an electron gun structured so as to emit three electron beams toward a phosphor screen.

There are generally six kinds of potentials necessary in total to be supplied to a color cathode ray tube, such as a cathode potential, a control grid potential, an accelerating electrode potential, a focus electrode potential, an anode potential, and a heater potential for heating the cathode. FIG. 5 is a longitudinal sectional schematic view illustrating the rough constitution of a conventional electron gun. Numeral 01 indicates a heater having two terminals, 02 a cathode, 03 a control grid, 04 an accelerating electrode, 05 a focus electrode, and 06 an anode.

FIG. 6 is a perspective view illustrating the structure of a stem sealed to an end of an evacuated envelope of a color cathode ray tube for supplying each of the aforementioned potentials from the outside of the color cathode ray tube to each of the electrodes therein. Numerals 14 and 14' indicate stem leads and 17 a stem.

In FIGS. 5 and 6, voltages are applied to the heater 01, the cathode 02, the control grid 03, the accelerating electrode 04, and the focus electrode 05 from the outside via the stem leads 14, 14'.

A potential difference of 5 to 10 V is given across the two terminals of the heater 01 by two stem leads so as to flow a current of 200 to 700 mA through the heater.

A cathode potential which corresponds to a display signal is applied on the cathode 02 so as to generate a modulated electron beam and a voltage of about 0 to −200 V is applied on the control grid 03 as a control grid potential.

A voltage of about 200 to 1000 V is applied on the accelerating electrode 04 as an accelerating electrode potential and a voltage of about 5 to 10 kV is applied on the focus electrode 05 as a focus electrode potential. A voltage of about 20 to 35 kV is applied on the anode 06 as an anode potential.

The stem leads 14 are arranged at a regular interval between them, but the stem lead 14' for applying a high voltage of about 5 to 10 kV on the focus electrode 05 is located at a distance of two times the regular interval from the adjacent other stem leads 14 so as to prevent arcing between the stem leads.

The electron gun of the aforementioned constitution operates as described below.

Thermoelectrons emitted from the cathodes 02 heated by the heater 01 are accelerated by the accelerating electrode potential toward the control grid 03 so as to generate three electron beams. The three electron beams pass through the apertures of the control grid 03 and the accelerating electrode 04, are slightly focused by the prefocus lens formed between the accelerating electrode 04 and the focus electrode 05 before entering the main lens formed between the focus electrode 05 and the anode 06, and enter the main lens as accelerated by the focus electrode potential.

The three electron beams are focused respectively on the phosphor screen by this main lens to form beam spots.

A high voltage to the anode 26 is supplied Via the so-called anode button embedded in the funnel portion of the evacuated envelope of the cathode ray tube.

The prior art relating to such a color cathode ray tube is disclosed, for example, in Japanese Patent Application Laid-open Sho 59-215640.

There is a problem imposed in a color cathode ray tube having the aforementioned prior art electron gun that the resolution at corners of the screen (phosphor screen) is lower compared with that at the central portion of the screen.

The first reason of the main reasons is that a self-convergent deflection yoke is generally used so as to scan electron beams on the phosphor screen, and the astigmatism caused by the self-convergent deflection yoke increases due to the non-uniformity of the magnetic field and the second reason is that electron beam focusing conditions are different between the central portion of the screen and the corners of the screen because the distance from the main lens to the corners of the screen is longer than that from the main lens to the central portion of the screen.

To solve the problem that the resolution at the corners of the screen decreases, Japanese Patent Application Laid-Open Sho 61-250933 discloses a method in which a focus electrode comprises at least a first focus electrode and a second focus electrode, an electrostatic quadrupole lens is formed with the opposite surfaces of both the focus electrodes, and a dynamic voltage varying according to an increase in the deflection angle of an electron beam is applied on one of the first and second focus electrodes.

However, to apply the dynamic voltage, it is necessary to increase the number of stem leads by one. When the number of stem leads is increased in the stem of a limited size, a problem arises that the distance between the stem leads shortens and the so-called breakdown voltage characteristic that an arc is apt to occur between the stem leads due to a potential difference between each stem lead is degraded.

SUMMARY OF THE INVENTION

An object of the present invention is to solve the aforementioned problem of the prior art and to provide a color cathode ray tube which can supply the required number of electrode potentials without increasing the number of stem leads.

To accomplish the above object, the present invention presents a constitution that one of two terminals of a heater is connected to a stem lead (shared stem lead) shared by one of the electrodes constituting an electron gun and a potential produced by superposing the required heater voltage on the potential supplied to the shared stem lead is supplied to the other terminal of the heater which is not connected to the shared stem lead.

According to an embodiment of the present invention, a color cathode ray tube comprises an evacuated envelope including a panel which carries a phosphor screen, a glass neck which houses an electron gun mount assembly, a funnel connecting said faceplate panel and said glass neck, and a stem having a plurality of leads therethrough sealed to and closing said neck at an end thereof; and an electron gun mount assembly, said electron gun mount assembly being supported on said stem via said plurality of leads and comprising a cathode for generating an electron beam and directing it toward said phosphor screen, a beam control grid electrode, an accelerating electrode, a plurality of focusing electrodes, one of said plurality of focusing electrodes being adapted to be supplied with a voltage varying in accordance with an amount of deflection of said electron beam, an anode electrode, and a heater for heating said cathode; one of two terminals of said heater and said beam control grid electrode being connected to a common one of said plurality of leads for being supplied with a variable voltage for beam control; and the other one of said two terminals of said heater being adapted to be supplied with a sum of said variable voltage for beam control and a voltage for heating said cathode.

Since one of the electrodes constituting the electron gun is connected to the shared stem lead together with one terminal of the heater, the required number of stem leads can be decreased by one.

Therefore, even if an additional stem lead is required so as to supply a dynamic voltage, the number of stem leads is equal to the conventional one. The distance between the stem leads is also left unchanged and the breakdown voltage characteristic is not degraded.

If the potential of the terminal of the heater connected to the not-shared stem lead is left fixed when the potential of the electrode connected with the other terminal of the heater is changed, a problem arises that a voltage different from the predetermined voltage is applied across the heater and the heater is broken. However, as mentioned above, when a predetermined potential difference applied across the heater is given via a not-shared stem lead with respect to the potential of the electrode connected to the stem lead shared by the other terminal of the heater, even if the potential of the electrode connected to the stem lead shared by the heater is changed, the potential difference applied across the heater can be kept at the predetermined value.

DETAILED DESCRIPTION OF THE PREFERRED EMBODIMENTS

The embodiments of the present invention will be explained in detail hereunder with reference to the accompanying drawings.

Figure 4:
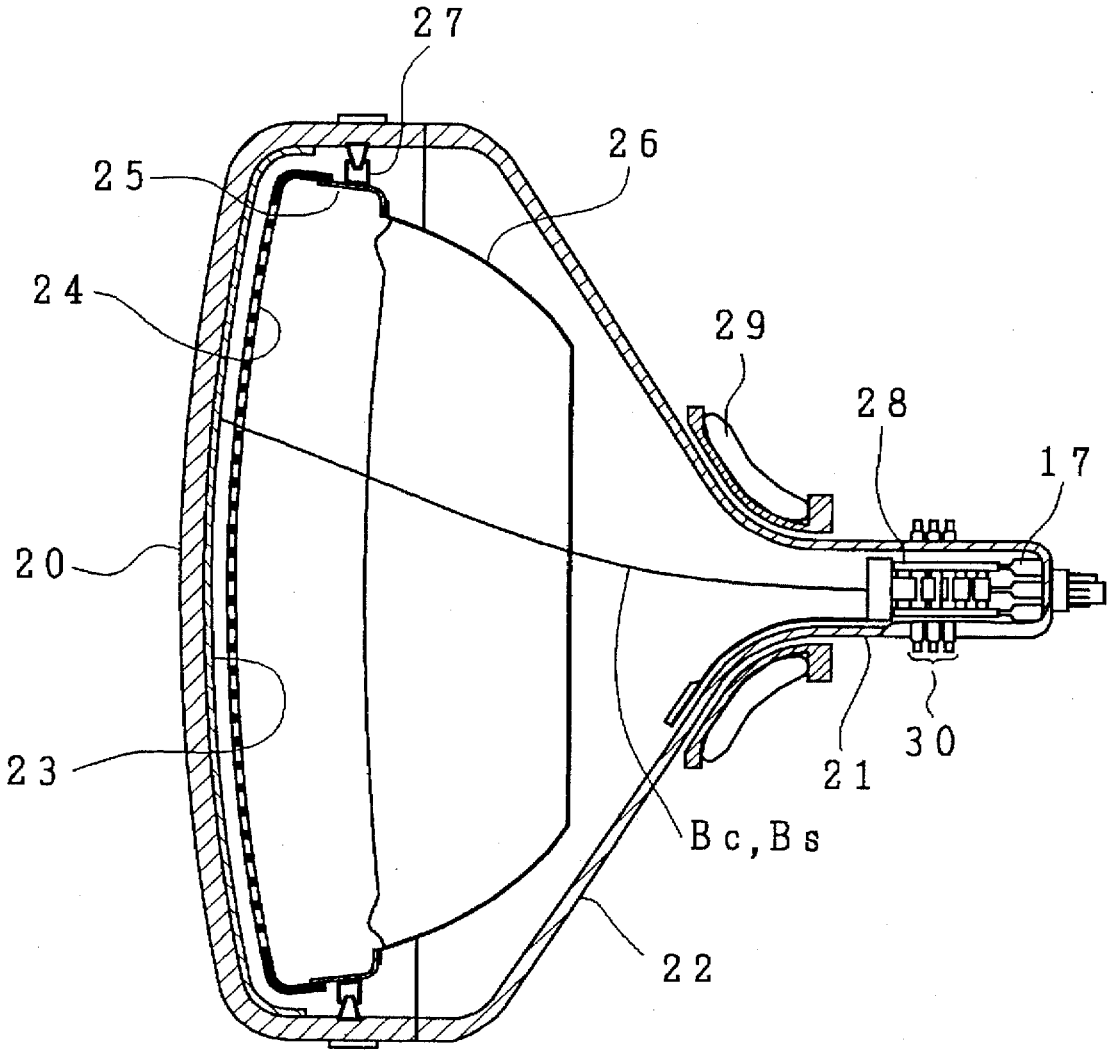
FIG. 4 is a cross sectional view illustrating the whole constitution of an embodiment of a color cathode ray tube of the present invention.
Figure 5:
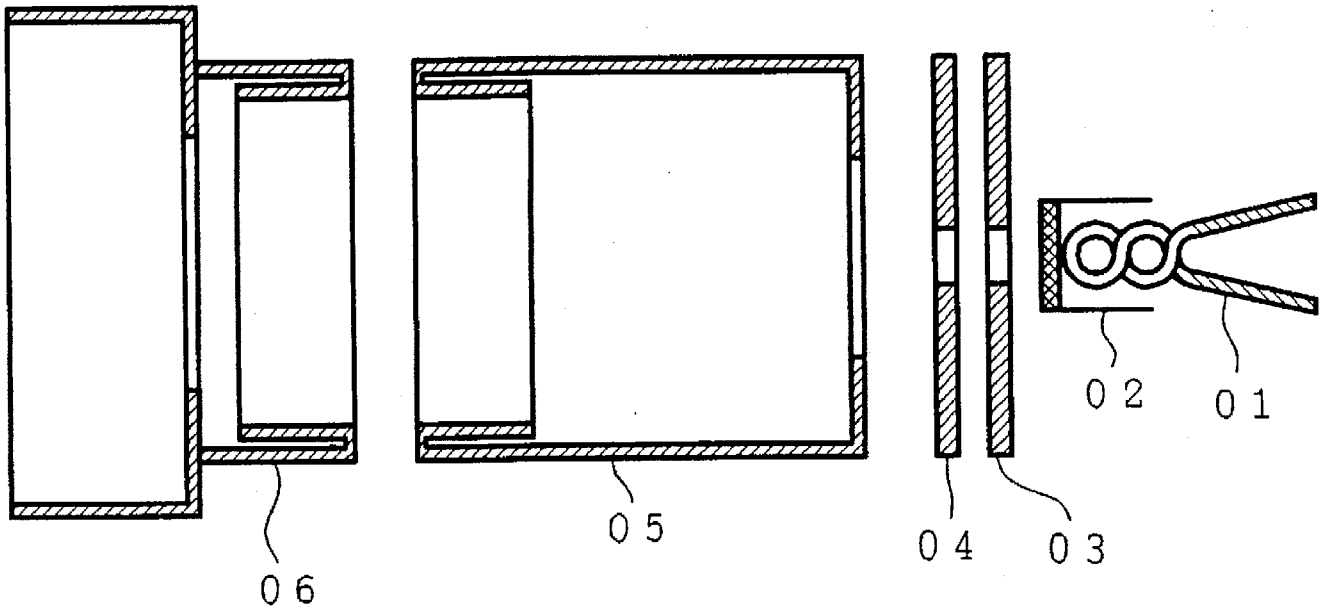
FIG. 5 PRIOR ART
FIG. 5 is a longitudinal sectional schematic view illustrating the rough constitution of a conventional electron gun.
Figure 6:
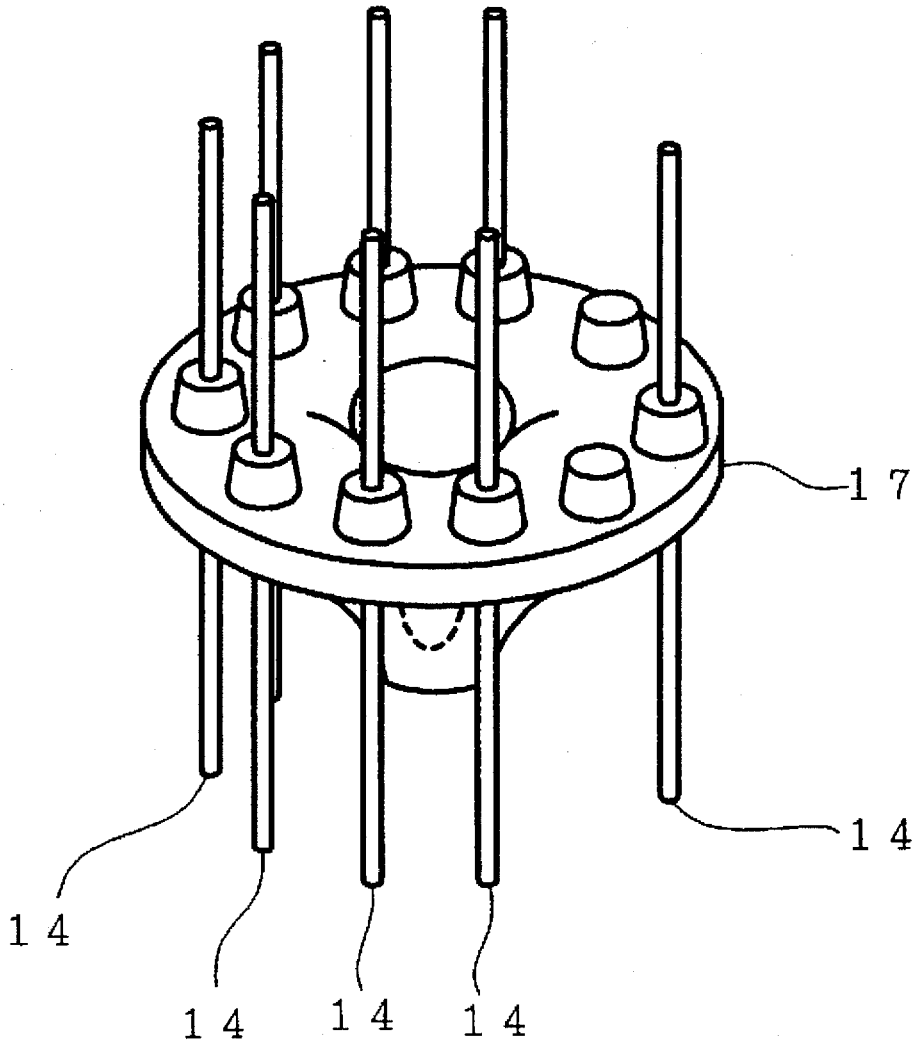
FIG. 6 is a perspective view illustrating the stem constitution for supplying each potential from the outside of a color cathode ray tube.

FIG. 4 is a cross sectional view illustrating the whole constitution of an embodiment of a color cathode ray tube of the present invention. Numeral 20 indicates a panel, 21 a neck, 22 a funnel, 23 a phosphor screen, 24 a shadow mask, 25 a mask frame, 26 a magnetic shield, 27 a suspension mechanism for the shadow mask, 28 an electron gun, 29 a deflection yoke, and 30 an external magnetic device.

In the color cathode ray tube, an evacuated envelope is formed of the panel 20, the neck 21, the funnel 22 connecting the panel 20 and the neck 21, and a stem 17 having a plurality of leads embedded therein for supplying voltages, sealed to and closing the neck 21 at the end thereof.

On the inner surface of the panel 20 is formed the mosaic three-color phosphor screen 23, a so-called screen, and the electron gun 28 emitting three electron beams in an in-line plane is housed inside the neck 21, and the shadow mask 24 having many apertures is located in the predetermined spaced relation to the phosphor screen of the panel 20.

The deflection yoke 29 is mounted in the transitional region between the funnel 22 and the neck 21.

The electron gun 28 has a constitution explained in an embodiment of the present invention which will be described later. The three emitted electron beams (Bc, Bs×2) are deflected in the two horizontal and vertical directions by the horizontal and vertical deflection magnetic fields generated by the deflection yoke 29, are subjected to color selection in the aperture of the shadow mask 24, and strike the respective phosphor screens so as to form a color picture.

Figure 1:
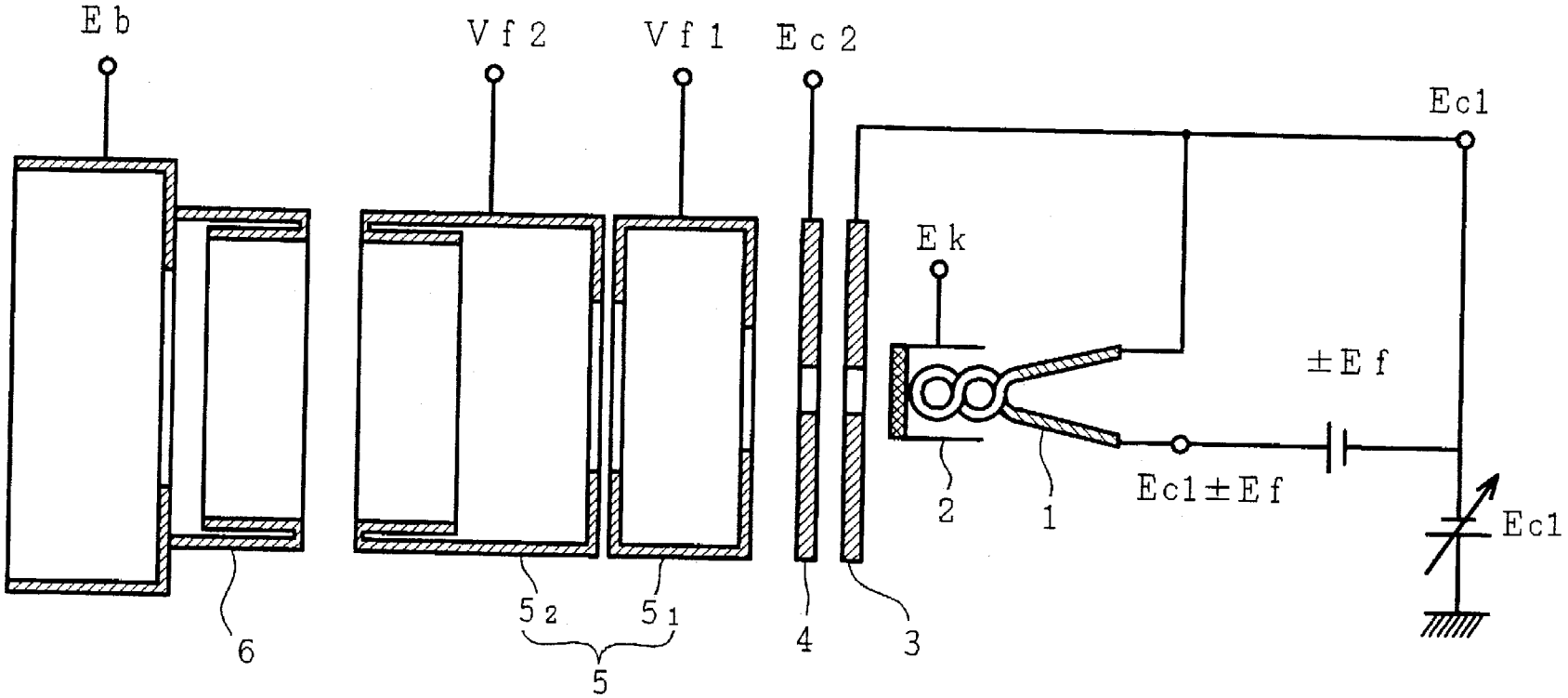
FIG. 1 is a longitudinal sectional schematic view illustrating the rough constitution of an electron gun for explaining an embodiment of a color cathode ray tube of the present invention.

FIG. 1 is a longitudinal sectional schematic view illustrating the rough constitution of an electron gun for explaining an embodiment of a color cathode ray tube of the present invention. Numeral 1 indicates a heater with two terminals, 2 a cathode, 3 a control grid, 4 an accelerating electrode, 5 a focus electrode, $\mathbf{5}_1$ a first focus electrode, $\mathbf{5}_2$ a second focus electrode, and 6 an anode.

In the figure, among a plurality of electrodes constituting the electron gun, one terminal of the heater 1 and the control grid 3 are connected to the common stem lead.

The potential difference across the heater 1 is Ef, the cathode potential Ek, the control grid potential Ec1, the accelerating electrode potential Ec2, the first focus electrode potential Vf1, the second focus electrode potential Vf2, and the anode potential Eb.

One of the first focus electrode potential Vf1 and the second focus electrode potential Vf2 is a dynamic voltage varying in synchronization with an amount of deflection of the electron beam.

On one of the two terminals of the heater 1 which is not connected to the stem lead in common with the control grid, applied is a voltage of Ef or −Ef with respect to the variable control grid potential Ec1. As a result, even if the variable control grid potential Ec1 varies, the potential difference applied across the heater 1 is kept constant.

Figure 2:
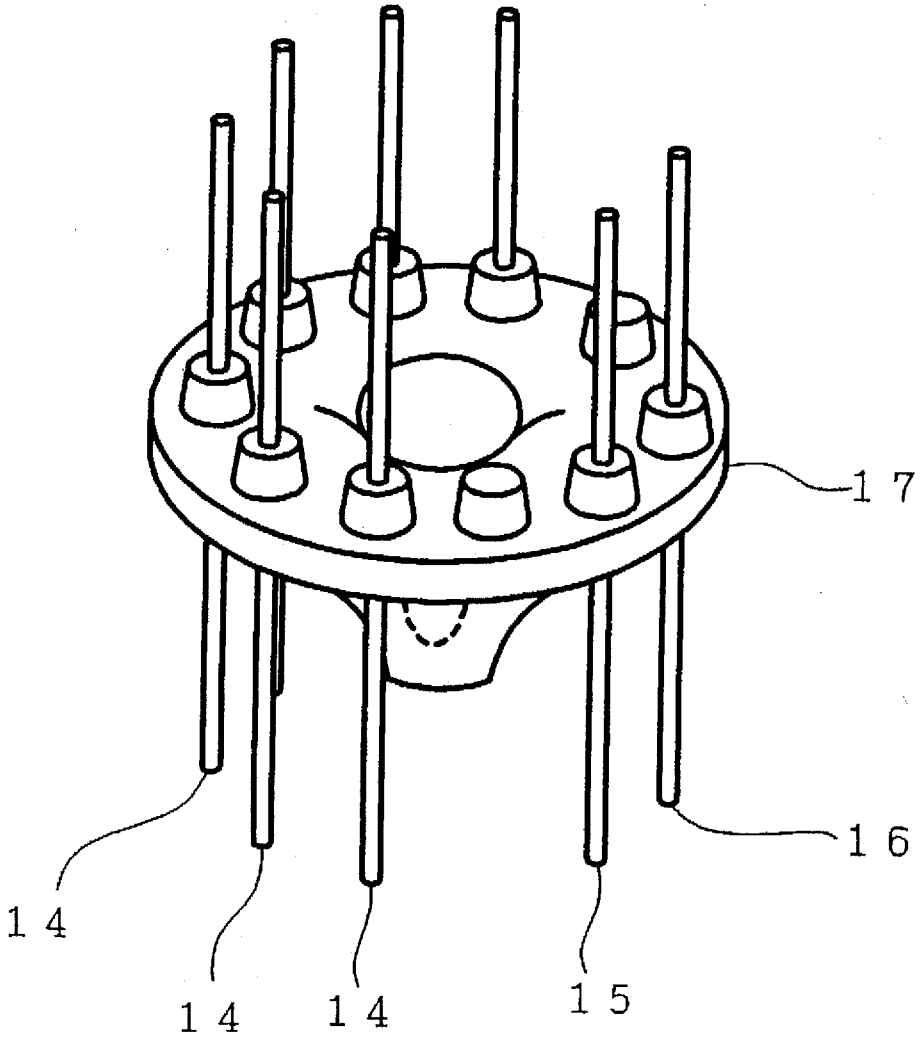
FIG. 2 is a perspective view illustrating the constitution of a stem sealed to an evacuated envelope for supplying a potential to each electrode of an electron gun from the outside of a color cathode ray tube of the present invention.

FIG. 2 is a perspective view illustrating the constitution of a stem sealed to an end of an evacuated envelope of a cathode ray tube and having leads for supplying a potential to each electrode of an electron gun from the outside of the color cathode ray tube of the present invention. Numerals 14, 15, and 16 indicate stem leads and 17 the stem.

The figure shows an example in which the present invention is applied to a stem having stem leads arranged on a circumference of a radius of 6 mm (pin circle radius of 6 mm) for use in a color cathode ray tube of the so-called small diameter neck type. The stem lead 15 for giving the potential Vf1 to the first focus electrode $\mathbf{5}_1$ and the stem lead 16 for giving the potential Vf2 to the second focus electrode $\mathbf{5}_2$ are extremely higher in potential than the stem leads 14 for giving the required potentials to the other electrodes, so that the intervals between the stem leads 15 and 16 and the other stem leads 14 are made larger than the regular intervals between the other stem leads 14 themselves by one regular interval so as to prevent arcing.

As mentioned above, according to this embodiment, there is no need to add an extra stem lead necessary to divide the focus electrode into two parts and supply a different potential to each of them, so that the number of stem leads is the same as the conventional one, and it can be avoided to narrow the stem lead intervals, and degradation of the breakdown voltage characteristic such as arcing between the adjacent stem leads can be prevented.

The present invention can be applied also to a cathode ray tube having a neck having stem leads on a pin circle of 7.5 mm in radius.

Figure 3:
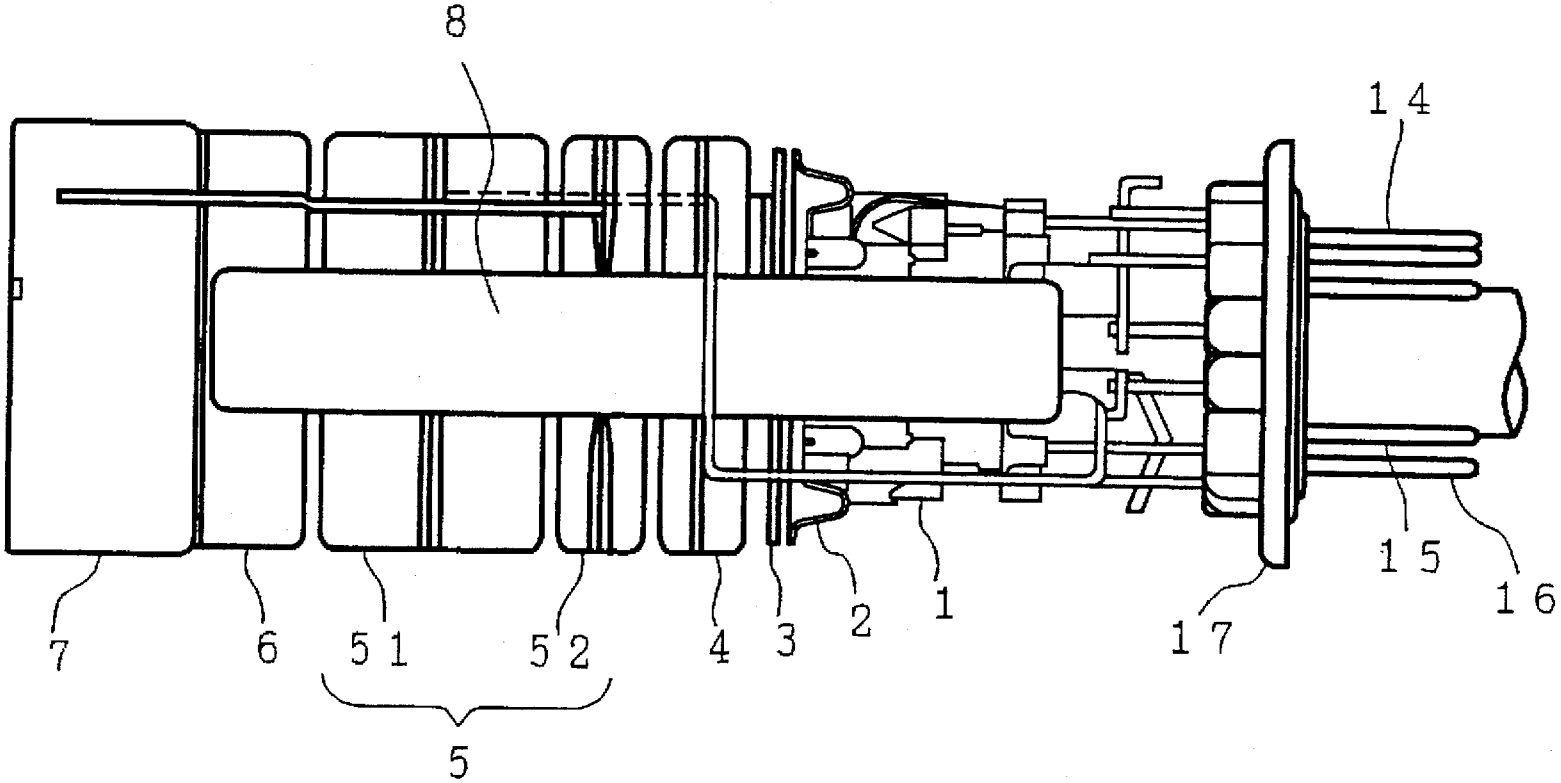
FIG. 3 is a side view showing a configuration example of an electron gun used in a color cathode ray tube of the present invention.

FIG. 3 is a side view showing a configuration example of an electron gun used in a color cathode ray tube of the present invention and each numeral which is the same as that in the aforementioned embodiment corresponds to the same part.

As shown in the figure, the heater 1, the cathode 2, the control grid 3, the accelerating electrode 4, the focus electrode 5, and the anode 6 constituting the electron gun are arranged coaxially in this order and the focus electrode 5 is divided into a first focus electrode 51 and a second focus electrode 52.

The required potential is supplied to each of these electrodes via the stem leads 14, 15, and 16 embedded in the stem 17.

The potentials to the first focus electrode 51 and the second focus electrode 52 constituting the focus electrode 5 are supplied via the stem leads 15 and 16.

The stem 17 is glass-welded to the neck portion of the cathode ray tube and the electron gun is sealed in the evacuated envelope.

As mentioned above, according to the present invention, in a color display system with color cathode ray tube having an electron gun in which the focus electrode is divided into two parts and a different focus voltage is supplied to each of the electrodes, there is no need to add an extra stem lead necessary to supply the aforementioned focus voltages, so that degradation of the breakdown voltage characteristic such as inducing of arcing between stem leads troublesome particularly in a color cathode ray tube having a small diameter neck can be avoided.

We claim:

1. A color display system including a color cathode ray tube comprising:

an evacuated envelope including a panel which carries a phosphor screen, a glass neck which houses an electron gun mount assembly, a funnel connecting said faceplate panel and said glass neck, and a stem having a plurality of leads therethrough sealed to and closing said neck at an end thereof; and an electron gun mount assembly, said electron gun mount assembly being supported on said stem via said plurality of leads and comprising a cathode for generating an electron beam and directing it toward said phosphor screen, a beam control grid electrode, an accelerating electrode, a plurality of focusing electrodes, one of said plurality of focusing electrodes being adapted to be supplied with a voltage varying in accordance with an amount of deflection of said electron beam, an anode electrode, and a heater for heating said cathode;

one of two terminals of said heater and said beam control grid electrode being electrically connected to a common one of said plurality of leads for being supplied with a variable voltage for beam control; and the other one of said two terminals of said heater being electrically connected to another one of said plurality of leads and adapted to be supplied with a sum of said variable voltage for beam control and a voltage for heating said cathode.

2. A color display system including a color cathode ray tube comprising:

an evacuated envelope including a panel which carries a phosphor screen, a glass neck which houses an electron gun mount assembly, a funnel connecting said faceplate panel and said glass neck, and a stem having a circular array of a plurality of leads therethrough sealed to and closing said neck at an end thereof; and an electron gun mount assembly, said electron gun mount assembly being supported on said stem via said plurality of leads and comprising a cathode for generating an electron beam and directing it toward said phosphor screen, a beam control grid electrode, an accelerating electrode, at least two focusing electrodes, one of said at least two focusing electrodes being adapted to be supplied with a voltage varying in accordance with an amount of deflection of said electron beam, an anode electrode, and a heater for heating said cathode;

one of two terminals of said heater and said beam control grid electrode being electrically connected to a common one of said plurality of leads for being supplied with a variable voltage for beam control;

the other one of said two terminals of said heater being electrically connected to another one of said plurality of leads and adapted to be supplied with a sum of said variable voltage for beam control and a voltage for heating said cathode; and spacings between focus-voltage leads of said plurality of leads connected to said at least two focusing electrodes and leads adjacent thereto being larger than spacings between leads of said plurality of leads excluding said focus-voltage leads.

3. A color display system according to claim 1, wherein said heater has a constant potential difference applied across said two terminals thereof even when said variable voltage for beam control is supplied to each of said two terminals of said heater.

4. A color display system according to claim 2, wherein said heater has a constant potential difference applied across said two terminals thereof even when said variable voltage for beam control is supplied to each of said two terminals of said heater.

* * * * *